United States Patent [19]

Sawai et al.

[11] 3,935,711

[45] Feb. 3, 1976

[54] FLAP GATE

[75] Inventors: Yukio Sawai; Yoshifumi Sakurai; Hiroshi Terata, all of Yokohama, Japan

[73] Assignee: Mitsubishi Jukogyo Kabushiki Kaisha, Tokyo, Japan

[22] Filed: June 10, 1974

[21] Appl. No.: 478,070

[30] Foreign Application Priority Data

June 15, 1973 Japan ..... 48-67895

[52] U.S. Cl. ..... 61/25

[51] Int. Cl.[2] ..... E02B 7/40

[58] Field of Search ..... 61/22, 24, 25, 27, 28, 61/29

[56] References Cited

UNITED STATES PATENTS

| | | | |
|---|---|---|---|
| 109,899 | 12/1870 | Heath | 61/25 X |
| 194,922 | 9/1877 | Marshall | 61/25 X |
| 1,223,763 | 4/1917 | Buchholz | 61/24 |
| 2,192,510 | 3/1940 | Smith | 61/22 R |
| 3,543,521 | 12/1970 | Aubert | 61/25 |

FOREIGN PATENTS OR APPLICATIONS

| | | | |
|---|---|---|---|
| 419,850 | 10/1925 | Germany | 61/25 |
| 735,547 | 5/1943 | Germany | 61/25 |
| 859,129 | 12/1952 | Germany | 61/25 |
| 1,119,177 | 12/1961 | Germany | 61/25 |
| 1,119,779 | 12/1961 | Germany | 61/25 |

*Primary Examiner*—Dennis L. Taylor
*Attorney, Agent, or Firm*—Cushman, Darby & Cushman

[57] ABSTRACT

A flap gate including a water gate door body of closed shell structure having a substantially rectangular vertical transverse cross-section with its bottom edge in the lengthwise direction being detachably supported on pivotal supports in such manner that said water gate door body can be freely erected and laid, is characterized in that the width a of said vertical transverse cross-section is selected one-sixteenths or less times as small as the distance *b* between said pivotal supports, and that when said water gate door body is vertically erected, a contact surface along the bottom edge of said door is brought in contact with a bank wall and also restrained by said pivotal supports so as not to separate from said bank wall.

1 Claim, 11 Drawing Figures

FLAP GATE

Figure 1:
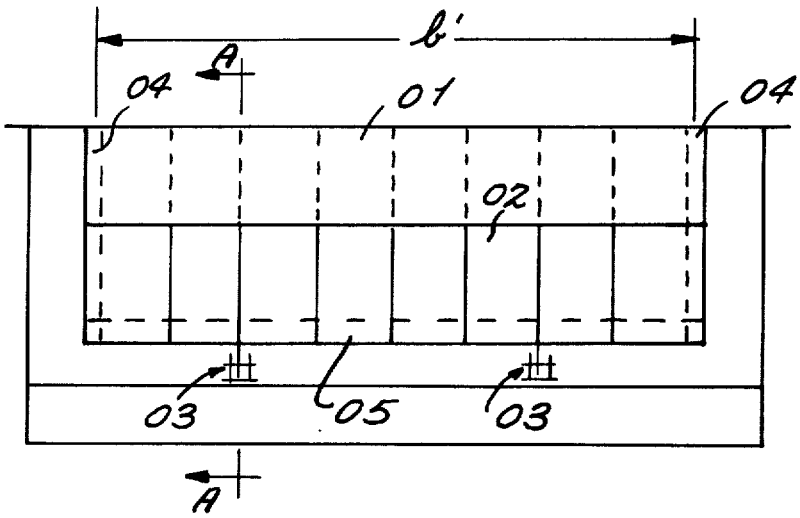
Fig. 1. PRIOR ART

The present invention relates to improvements in a flap gate.

A flap gate of such type that front surface edge portions of a door body is brought in contact with a bank wall while being applied with a hydraulic pressure to dam up water and pivotal supports are provided along the bottom edge of said door body, has been heretofore used without trouble in case that the distance between said pivotal supports is relatively small. However, if such type of flap gate is applied to flap gates having a very large distance between pivotal supports such as those constructed recently, then various difficulties would occur.

Describing now the above-described type of flap gate in connection to the conventional dock flap gate with reference to FIGS. 1 through 6, reference numeral 01 designates a main beam, numeral 02 designates vertical beams, numeral 03 designates pivotal supports provided along the bottom edge of a door body on its left and right sides, numeral 04 designates side wooden seats, numeral 05 designates a bottom wooden seat, numeral 06 designates a side wall of a dock, numeral 07 designates a bottom of the dock, and numeral 08 designates a water-tight sealing rubber piece fixedly secured to the bottom wooden seat 05.

Said pivotal support 03 consists of a support receiver 011 fixed to the sea bed outside of the dock bottom, a support shaft 09 fixedly and horizontally secured to said support receiver 011, and a support piece 010 mounted to the lower end of the vertical beam 02 and having a recessed portion, while the door body can be operated so as to be erected or laid with the support shaft 09 fitted in the recessed portion of the support piece 010 and supported thereby. The width $d$ of the recessed portion of the support piece 010 riding on the support shaft 09 is sufficiently large in comparison to the diameter of the support shaft 09, so that when the door body is vertically erected, only the weight of the door body is transmitted to the support shaft 09 and said support shaft 09 is not restrained relative to the support piece 010.

Figure 2:
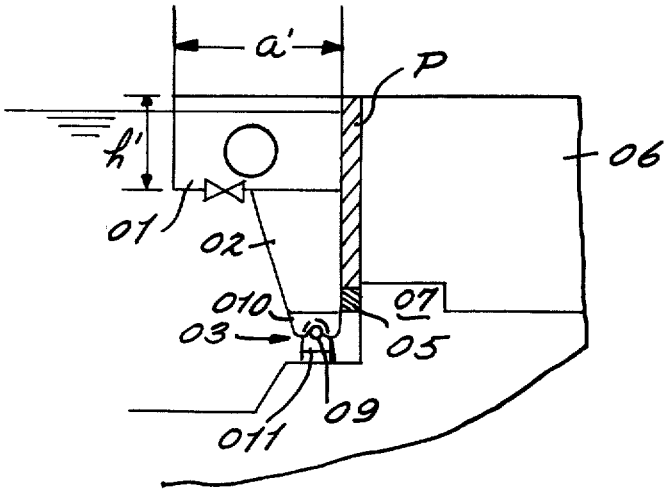
Fig. 2. PRIOR ART

Explaining now the load transmission mechanism in the abovedescribed flap gate of the prior art type, in FIG. 2 the load applied from the side of the sea is transmitted via the door plate to the vertical beams 2, which are in turn supported by the bottom 07 of the dock through the main beam 01 and the bottom wooden seats 05. The main beam 01 is supported by the side walls 06 of the dock via the side wooden seats 04. The main beam 01 functions mainly as a bending member, and for the sake of reducing the effect of waves a box type of cross-section is employed for its transverse cross-section configuration.

It is required in view of a mechanical strength that the width $a'$ of the box is selected about 1/10 times as small as the distance $b'$ between the pivotal supports, while the height $h'$ of the box is determined so that the bottom surface of the box may be sufficiently lower than the lowest water level of the sea.

The above-described prior art type of flap gate can be used without trouble provided that the distance between the pivotal supports is at most equal to about 50 m. However, according to the tendency of demand for docks constructed recently, the height is not so much different from that of the prior art flap gate, but the distance between the supports has been extremely increased, and thus flap gates having the distance between the supports of about 100 m have been increasingly constructed. Accordingly, the following faults and disadvantages have come out in the case of the prior type.

I. There occurs a tendency that the bottom portions of the opposite side ends of the flap gate may possibly separate from the dock wall, resulting in leakage of water from these separated portions.

Figure 5:
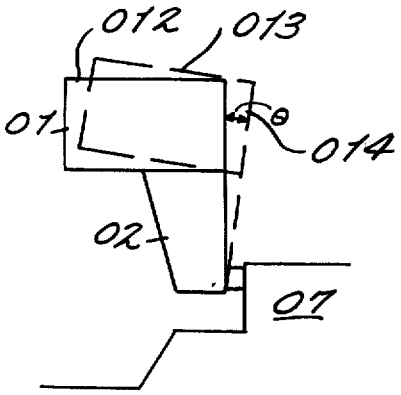
Fig. 5. PRIOR ART

Explaining this phenomenon with reference to FIG. 5, when a hydraulic pressure is applied to the door body, the middle portion of the door body is displaced from its normal position as represented by solid lines 012 to another position as represented by dash lines 013. In this figure, reference numeral 014 designates an angle of rotation $\theta$. Since the main beam 01 has a box type of cross-section which results in a fairly large resistance against a torsion, the opposite, left and right side end portions of the flap gate in FIG. 1 have a tendency of rotating as induced by the angle of rotation $\theta$. Because this tendency is increased substantially in proportion to a square of the distance $b'$ between the supports, if the distance $b'$ between the supports exceeds a certain value, the torque of the reactive forces for preventing the rotation of the opposite side end portions is overcome by the torque generated from the hydraulic pressure and transmitted via the main beam 01, and consequently, the opposite side end portions would rotate about a fulcrum point at its top edge $p$ (See FIG. 2). Thus, the water-tight nature cannot be maintained, because of the fact that the bottom ends of the opposite side end portions of the flap gate making contact with the edge surface of the bottom 07 of the dock, are caused to swing up.

II. There occurs increase of a bending moment in the proximity of the midpoint of the distance $b'$ between the supports.

This phenomenon has a complementary relation to the swing-up of the bottom ends of the opposite side end portions of the door body as described in the preceding numbered paragraph (I). Explaining this phenomenon with reference to FIG. 6, the reaction force exerted upon the central portion of the door body is shown in this figure, in which R represents the reaction force exerted from the bottom 07 of the dock, and L represents the distance from the support edges of the vertical beams 02 on the side of the main beam 01 to the line of action of the reaction force R. Here, the bending moment about the support edges of the vertical beams 02 on the side of the main beam 01 is equal to $R \times L$. However, since the reaction force becomes zero at the opposite side end portions where the bottom ends swing up as described in the preceding numbered paragraph (I), the reaction force in the proximity of the midpoint is increased by the corresponding amount, and thus the bending moment in the proximity of the midpoint is increased accordingly.

If the distance $b'$ between the supports is increased, this tendency would become more remarkable, and therefore, it becomes very difficult to limit the stress applied to the vertical beams to within an allowable range unless the cross-section area of the vertical beam is selected sufficiently large. However, if the cross-section area of the vertical beam is enlarged, although the problem relating to the stress is resolved, the weight of the entire water gate door body is increased, and consequently, the enhancement of cost cannot be avoided.

III. The amount of excavating the sea bed on the side of the sea where the flap gate is to be laid, is increased.

Since the width $a'$ of the box is extremely increased, it is necessary to excavate the sea bed more deeply for perfectly laying the door body, and consequently, the expense for constructing the water gate would be increased.

It is an object of the present invention to eliminate the the aforementioned disadvantages of the flap gate in the prior art, in which there are provided a main beam and vertical beams under said main beam, and pivotal supports for allowing a door body to be erected and laid merely serve to make the door body swing thereabout and to support the same.

One feature of the present invention is to provide a flap gate including a water gate door body of closed shell structure having a substantially rectangular vertical transverse cross-section with its bottom edge in the lengthwise direction being detachably supported on pivotal supports in such manner that said water gate door body can be freely erected and laid, characterized in that the width $a$ of said vertical transverse cross-section is selected one-sixteenth or less times as small as the distance $b$ between said pivotal supports, and that when said water gate door body is vertically erected, a contact surface along the bottom edge of said door is brought in contact with a bank wall and also restrained by said pivotal supports so as not to separate from said bank wall.

Figure 3:
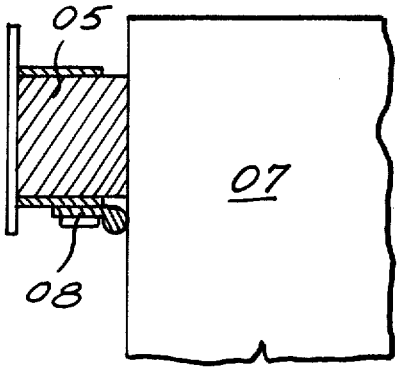
Fig. 3. PRIOR ART
Figure 4:
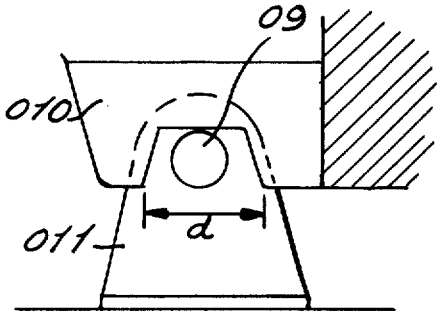
Fig. 4. PRIOR ART
Figure 6:
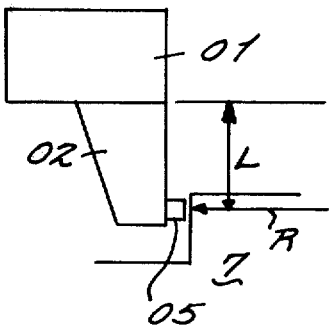
Fig. 6. PRIOR ART
Figure 7:
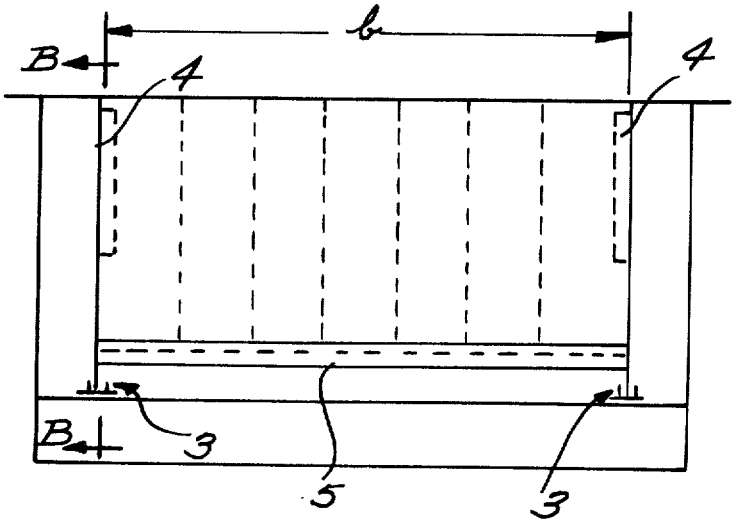
Figure 8:
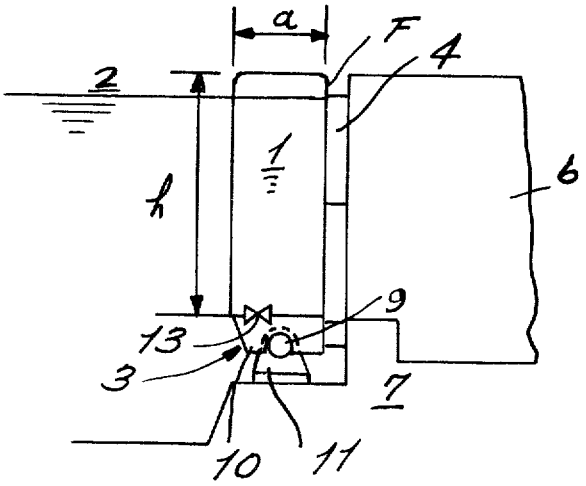
Figure 9:
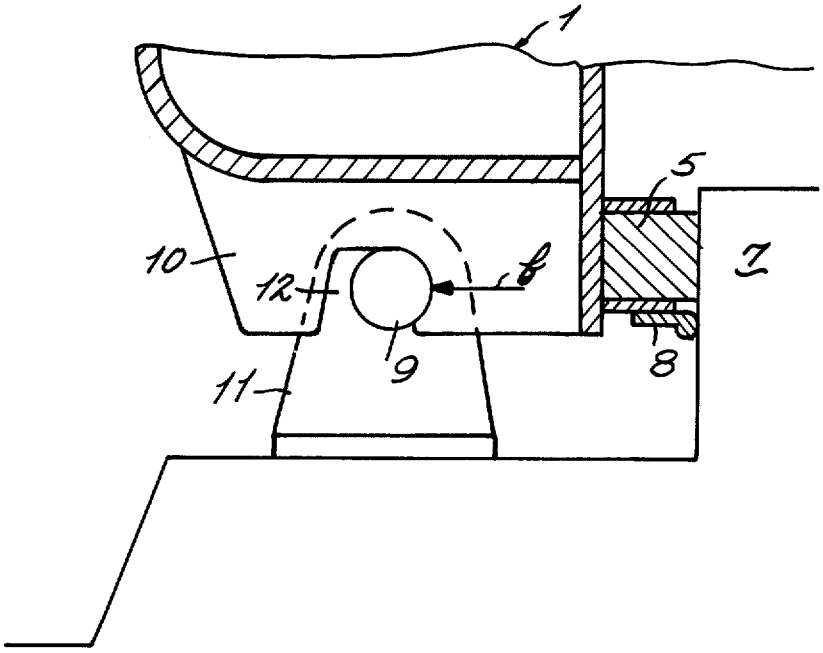
Figure 10:
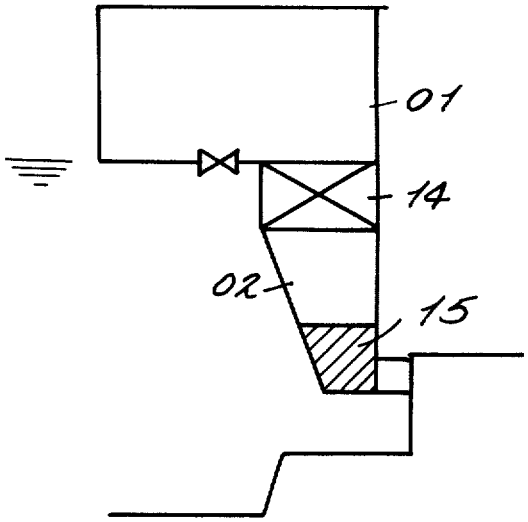
Fig. 10. PRIOR ART
Figure 11:
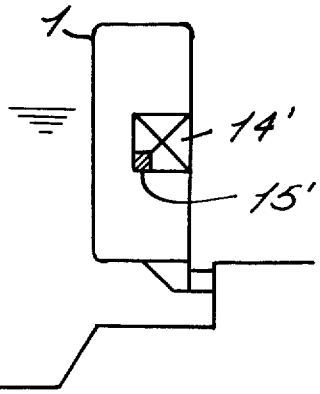

Other objects and features of the present invention will become apparent upon a perusal of the following specification taken in connection with the accompanying drawings, in which:

FIGS. 1 through 6 show a flap gate equipped in a dock of the prior art type, FIG. 1 being a front view as viewed from the side of the sea, FIG. 2 being a cross-section view taken along line A—A in FIG. 1 as viewed in the direction of arrows, FIG. 3 being an enlarged view of the proximity of the bottom wooden seat in FIG. 2, FIG. 4 being an enlarged view of the pivotal support portion in FIG. 2, FIG. 5 being a diagrammatic view showing a displacement of the central portion caused by a load of hydraulic pressure, and FIG. 6 being a diagrammatic view showing a reaction force at the central portion of the door body, FIGS. 7 through 9 show one preferred embodiment of the present invention, FIG. 7 being a front view as viewed from the side of the sea of a flap gate equipped at an entrance of a dock, FIG. 8 being a cross-section view taken along line B—B in FIG. 7 as viewed in the direction of arrows, and FIG. 9 being an enlarged detailed view of the proximity of the pivotal support portion in FIG. 7, and FIGS. 10 and 11 are schematic views for comparatively showing the amounts of balast loading in a flap gate of the prior art type and in a flap gate according to the present invention, respectively.

Now one preferred embodiment of the present invention will be described with reference to FIGS. 7, 8, 9 and 11.

Reference numeral 1 designates a door body having a closed shell cross-section configuration whose width is far smaller than the distance between the supports, numeral 2 designates the side of the sea, numeral 3 designates pivotal supports provided at the bottom of the opposite side ends in the lengthwise direction of the door body 1, numeral 4 designates side wooden seats provided on the opposite sides of the frant surface F of the door body 1, numeral 5 designates a bottom wooden seat provided along the bottom edge of the front surface F of the door body 1 as directed in its lengthwise direction, numeral 6 designates dock walls, numeral 7 designates a bottom of the dock, numeral 8 designates a water-tight sealing rubber piece fixedly secured to the bottom wooden seat 5, and numeral 13 designates a water passage opening provided in the lower portion of the door body 1.

In the aforementioned structure, the pivotal support 3 comprises a combination consisting of a pair of left and right support receivers 11 fixed on the sea bed outside of the bottom of the dock and having a horizontal support shaft 9 for supporting the door body 1 supported thereon, and a support piece 10 mounted at the bottom of the door body 1 at its left or right end and having a downwardly recessed portion 12.

The width $a$ of the door body is about one-sixteenth or less times, preferably about one-twentieth or less times as small as the distance $b$ between the supports, and the height $h$ is substantially equal to the height of the dock.

When the door body 1 is vertically erected, that is, when the dock is vacant and blocked from the sea water, the support shaft 9 makes contact with the right side face of the recessed portion 12 of the support piece 10 as shown in FIG. 9, so that the support shaft 9 is applied with a reaction force $f$ from the right side face of the recessed portion 12, and thus the support shaft 9 and the support piece 10 are engaged with each other so that the door body 1 may not separate from the bottom 7 of the dock.

Explaining now the operation of the above-described structure, when a hydraulic pressure is applied to the door body 1 under the condition of blocking the entrance of the dock, most of the hydraulic pressure load is borne by the bottom wooden seat 5 via the door body 1. Accordingly, a torque is exerted upon the door body 1 in such direction that the door body 1 is caused to fall on the opposite side to the sea. This torque is transmitted to the opposite side ends of the door body 1 as a torsional shearing stress in the vertical transverse cross-section of the door body, and balanced by the torque of the supporting reaction forces exerted by the side wooden seats 4 and the support receivers 11. In other words, the reaction force $f$ is borne by the support shaft 9, so that no gap clearance is produced at the bottom of the opposite side ends of the door body 1. By way of examples, it is to be noted that in an embodiment having dimensions of $b = 100$ m, $a = 5$ m and $h = 12$ m, $f = 2000$ ton is resulted, while in another embodiment having dimensions of $b = 80$ m, $a = 5$ m and $h = 12.85$ m, $f = 1400$ ton is resulted.

In more particular, since the entire cross-section area of the hollow door body 1 is very large, its torsional rigidity is extremely high, and since the width $a$ of the cross-section is small, its bending rigidity is very low. As described above, the rotation of the opposite side end portions of the door body 1 is completely restrained by the support shaft 9. The requirement that the width of said door body should be about one-sixteenth or less times, preferably about one-twentieth or less times as small as the distance $b$ between the supports, has been determined on the basis of both calculations and experiments. Briefly stating, when the width $a$ is reduced, the bending moment is remarkably decreased owing to the fact that the bending rigidity IE of the door body is proportional to a square of the width

*a*. On the other hand, even if the width *a* is reduced, the torsional rigidity JE can be maintained high by selecting the height *h* sufficiently larger than the width *a*, because the torsional rigidity JE is proportional to a square of $a \times h$. If the height *h* is selected larger than about 2*a* in such a viewpoint, then the internal force is mainly borne by a member having a torsional rigidity, and thus the door body can be designed principally on the basis of torsion.

As described above, according to the present invention, the door body is constructed to have a closed shell structure whose vertical transverse cross-section has a width about one-sixteenth or less times, preferably about one-twentieth or less times as small as the distance between the supports, and the pivotal supports for supporting the door body restrains the door body to prevent the bottom of the side ends of the door body from separating from the dock walls, and as a result, the following effects and advantages can be expected from the present invention:

1. Since the width of the door body is selected about one-sixteenth or less times, preferably about one-twentieth or less times as small as the distance between the supports, the bending rigidity within a horizontal plane is reduced, and consequently, the bending moment becomes small. This is because the internal forces of the door body are indefinite in view of the theory of statics since the door body is supported along its three edges, and because a torsional member having a high rigidity bears against a large internal force.
2. The bottoms of the opposite end portions of the door body do not swing up as is the case with the conventional flap gate structure, and therefore, water leakage would not occur.
3. Since the vertical beam portions in the prior art structure are eliminated, there occurs no problem relating to the bending moment, and further, since the width of the door body is made smaller than that of the prior art structure, the amount of excavating the sea bed can be reduced.
4. Inasmuch as the torsional rigidity is extremely high with respect to the bending rigidity, the thickness of the plate is determined by the torsional moment, so that the thickness of the plate can be made about one-third times as small as that of the prior art flap gate, and consequently, the welding work is simplified with a little distortion, which leads to improvements in working efficiency and to reduction of cost caused by decreasing the weight of the door body.

By way of examples, a several examples of comparison in weight between the known flap gates in the prior art as shown in FIG. 2 and the flap gates according to the present invention having the respective distances *b'* and *b* between the supports and the effective heights H of the water gates equalized to each other, are listed up in the following table, in which it is indicated that the present invention is distinctly effective even if the ratio *a/b* is substantially equal to one-sixteenth and the invention is useful even if the ratio *h/a* is equal to 1.8.

| | Distance between Supports | Effective Height of Gate | Width of Gate | Dimension Ratio | Dimension Ratio | Weight | | Weight Reduction Ratio |
|---|---|---|---|---|---|---|---|---|
| | | | | | | Door Body in FIG. 2 | Door Body of Present Invention | |
| No. | b (m) | H (m) | a(m) | a/b | h/a | W'(t) | W (t) | W/W' |
| 1 | 100 | 13.5 | 5.0 | 1/20 | 2.4 | 1900 | 1270 | 0.67 |
| 2 | 90 | 13.0 | 5.0 | 1/18 | 2.6 | 1700 | 1100 | 0.65 |
| 3 | 80 | 13.0 | 5.0 | 1/16 | 2.5 | 1500 | 1000 | 0.67 |
| 4 | 55 | 8.0 | 2.5 | 1/22 | 1.8 | 410 | 201 | 0.49 |
| 5 | 45 | 8.2 | 2.5 | 1/18 | 2.0 | 300 | 229 | 0.76 |

5. With reference to FIGS. 10 and 11 showing the designs of float and ballast sections in the door bodies according to the prior art and the present invention, respectively, each door body is provided with a float 14 or 14' for reducing the winch load of the door body and for repairing works, and also loaded with a ballast 15 or 15' for bringing the center of gravity of the door body to its center of buoyancy. In the door body according to the present invention, the amount of the ballast can be reduced to a very small amount because the center of gravity of the door body without the balast is closer to its center of buoyancy than in the case of the door bodies in the prior art.

Since many changes could be made in the above construction and may apparently widely different embodiments of this invention could be made without departing from the scope thereof, it is intended that all matter contained in the above description or shown in the accompanying drawings shall be interpreted as illustrative and not in a limiting sense.

What is claimed is:

1. For closing the partially submerged entrance opening of a dock or the like, having opposite sidewalls, a bottom and a bank wall extending down from the bottom, a flap gate structure, comprising:

a water gate door body of closed shell structure, having when closed, a substantially rectangular vertical transverse cross-section;

a pair of fixed, horizontally extending support pins about which the door is to pivot when moving from being erected to being laid out and vice versa;

a pair of support pieces mounted on the water gate door body, each support piece having surface means defining a downwardly opening recess for receiving a respective one of said support pins;

means defining a contact surface along the bottom edge of the water gate door body, arranged for contact with the bank wall when the door is erected;

the thickness of the water gate door body being no greater than one-sixteenth times the distance between where the two support pieces receive the two support pins;

said surface means defining the recesses being so spatially arranged relative to said contact surface and the bank wall that, when the water gate door body is erected the surface means presses laterally against the respective pins on their side which is toward the bank wall, to prevent the contact surface from separating from the bank wall.

* * * * *